United States Patent [19]

Rebuschat

[11] 4,009,869

[45] Mar. 1, 1977

[54] APPARATUS FOR TREATMENT OF ROLLED WIRE

[75] Inventor: Karl Rebuschat, Duisburg, Germany

[73] Assignee: Demag Aktiengesellschaft, Duisburg, Germany

[22] Filed: Aug. 6, 1975

[21] Appl. No.: 602,200

[30] Foreign Application Priority Data

Aug. 10, 1974 Germany ..... 2438565

[52] U.S. Cl. ..... 266/112; 148/155; 266/133; 294/67 BC; 294/97

[51] Int. Cl.[2] ..... C21D 1/62

[58] Field of Search ..... 140/153, 155; 266/3 R, 266/6 R, 111, 112, 130–133; 294/67 BC, 97

[56] References Cited

UNITED STATES PATENTS

| | | | |
|---|---|---|---|
| 1,739,620 | 12/1929 | Summey | 266/3 R X |
| 1,882,704 | 10/1932 | Andersen et al. | 294/67 BC |
| 2,951,725 | 9/1960 | St Jean | 294/97 |
| 3,128,118 | 4/1964 | Ezzell | 294/97 |
| 3,276,920 | 10/1966 | Sims | 148/155 X |
| 3,604,691 | 9/1971 | Sherwood | 148/153 X |

FOREIGN PATENTS OR APPLICATIONS

| | | | |
|---|---|---|---|
| 4,714,619 | 1972 | Japan | 148/155 |

*Primary Examiner*—Roy Lake
*Assistant Examiner*—Paul A. Bell
*Attorney, Agent, or Firm*—Mandeville and Schweitzer

[57] ABSTRACT

Apparatus is provided for cooling rolled wire after rolling by the application of a liquid treatment medium, which apparatus requires substantially less space and retention time for treatment than previous devices utilizing liquid mediums, but which still accommodates the rolled product issuing from a high speed large capacity production line. This is achieved by coiling the wire and simultaneously continuously immersing it in the container holding the liquid treating medium, so that at the moment each coil of wire is completed, it is also properly treated. Also included are means for sequentially coiling and removing each coil of rolled wire from the liquid treatment container.

7 Claims, 4 Drawing Figures

APPARATUS FOR TREATMENT OF ROLLED WIRE

STATEMENT OF THE INVENTION

The invention covers apparatus for heat treatment of rolled wire to remove the heat therefrom produced by rolling and/or to otherwise treat the rolled wire, such apparatus consisting of a reel for winding the wire around a vertical axis, and a container arranged underneath the reel providing the heat treatment.

BACKGROUND OF THE INVENTION

Already known is a method for cooling hot wire in air. The wire, coiled vertically and in spaced windings, is inserted into a duct or shaft. The coils are transported down the duct by means of a number of endless conveyor chains equipped with spaced fingers protruding toward the duct interior in a star-like arrangement. The coiled wire windings are deposited sequentially on the fingers. The finished bundle is removed at the lower end of the duct. Furthermore, it is known to treat steel wire by cooling in a lead bath or in a saline smelt. In this method, the wire is pulled through a tub containing the liquid medium. The disadvantage of such an installation is the space requirements, particularly if the installation has a large capacity, and the wire passes through at a correspondingly high speed, as the treatment line must be of suitable length to provide the required retention period for exposure to treatment.

DESCRIPTION OF THE INVENTION

This invention, by contrast, provides apparatus with the advantage of limited demand for space, as in the case of installations cooling the wire by exposure to air flow. However, treatment of the wire is with a liquid medium. The liquid treating chamber is closed at the bottom, and filled with a liquid heat treating medium. The reel for coiling the rolled wire is moved from its operating position above the container to a rest position, in which it frees the top opening of the container. Because of this, very fast treatment times can be obtained as the entire time of forming each bundle or coil in the container is used for the treatment. With the invention here, even the wire portion last coiled into the bundle has sufficient dwell time for treatment to achieve the desired improvement in quality. Thus, it is possible to have a very efficient heat treatment installation with a minimum of required space.

The apparatus of the invention operates sequentially, and it is therefore essential to keep the period for removing the finished bundle or coil from the treatment chamber as short as possible. This is done by moving the coiling reel, after coiling a bundle, away from the top opening of the container. In view of the relatively small bulk of the reel, this motion is done quickly. This results in the additional advantage that the container with the liquid treatment medium is only large enough to accommodate each coiled bundle. Accordingly, the amount of treatment medium needed is substantially less than previously required for liquid treatment application.

In order to remove the finished bundle as quickly as possible from the container, the invention includes a hoisting unit to be moved independently of the coiling reel into and out of position above the upper opening of the container. The hoisting unit is equipped with a load carrying device which is lowered into the container.

Due to the mobility of the coiling unit and the hoisting removal unit, a fast change between formation of the bundle and removal of the bundle is achieved.

For moving the coil reel and its drive unit into and out of position over the treating chamber, they are supported on a frame guided along rails, and the frame is moved back and forth between operating and rest position of the reel by means of another drive unit. In order to keep the container opening accessible during the alternate use of the coiling reel and the hoisting unit, guide rails for the frame are terminated at a distance spaced from the container opening. The reel is suspended or cantilevered from its supporting frame to overhang the container.

The hoisting unit is also movable on a separate set of guide rails, and carries a winch which supports a frame suspended or cantilevered to overhang the container and equipped with pulleys and a cable supporting a load carrying device. The load carrying device may consist of rods hanging from a headpiece, for example. In use, the rods are inserted into the space between the container interior and the bundle exterior. The rods may have pivotal fingers or extensions on the bottom ends which can be turned inward to reach under the bundle or coil which is being lifted.

Other objects and advantages of this invention will be apparent from the following detailed description of an illustrative embodiment, the accompanying drawings, and the appended claims.

DESCRIPTION OF A PREFERRED EMBODIMENT

Figure 1:
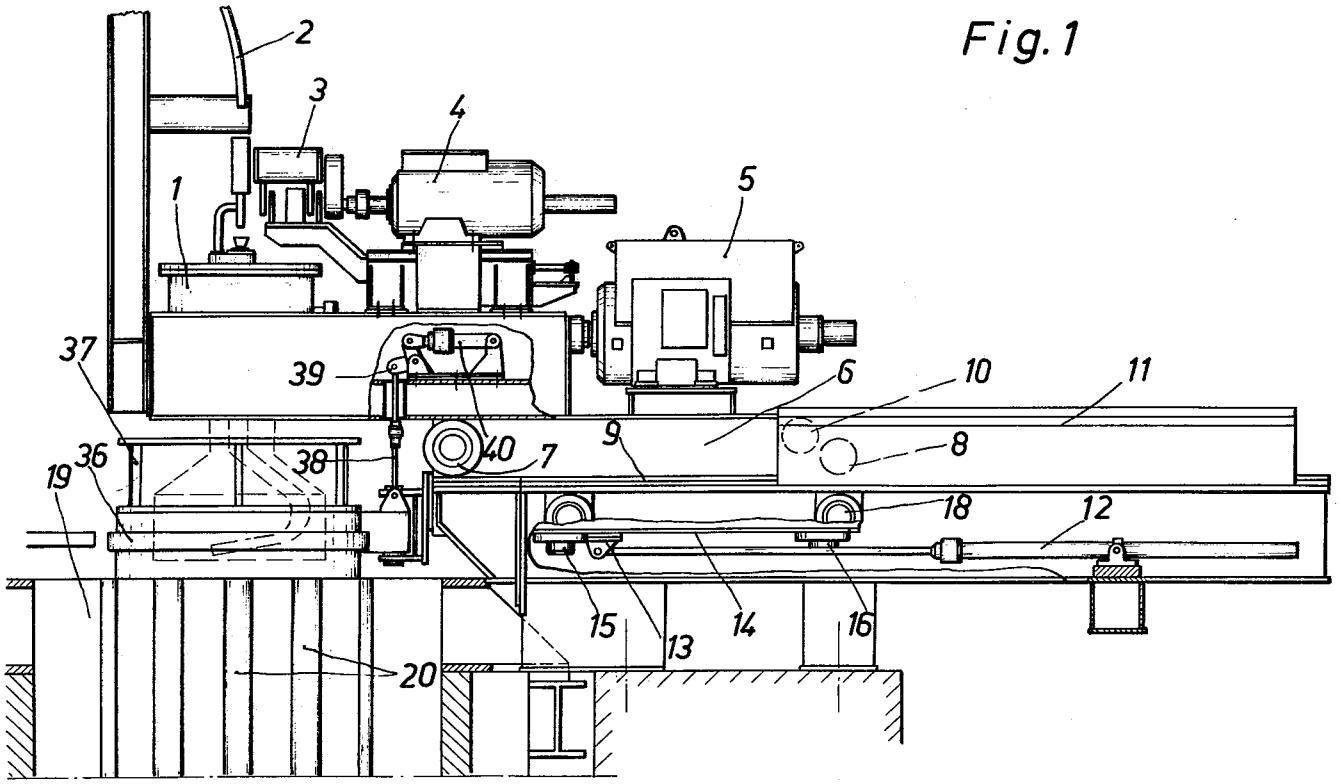
FIG. 1 is a side elevational view, partially cut away, illustrating apparatus embodying and for practicing the invention.
Figure 2:
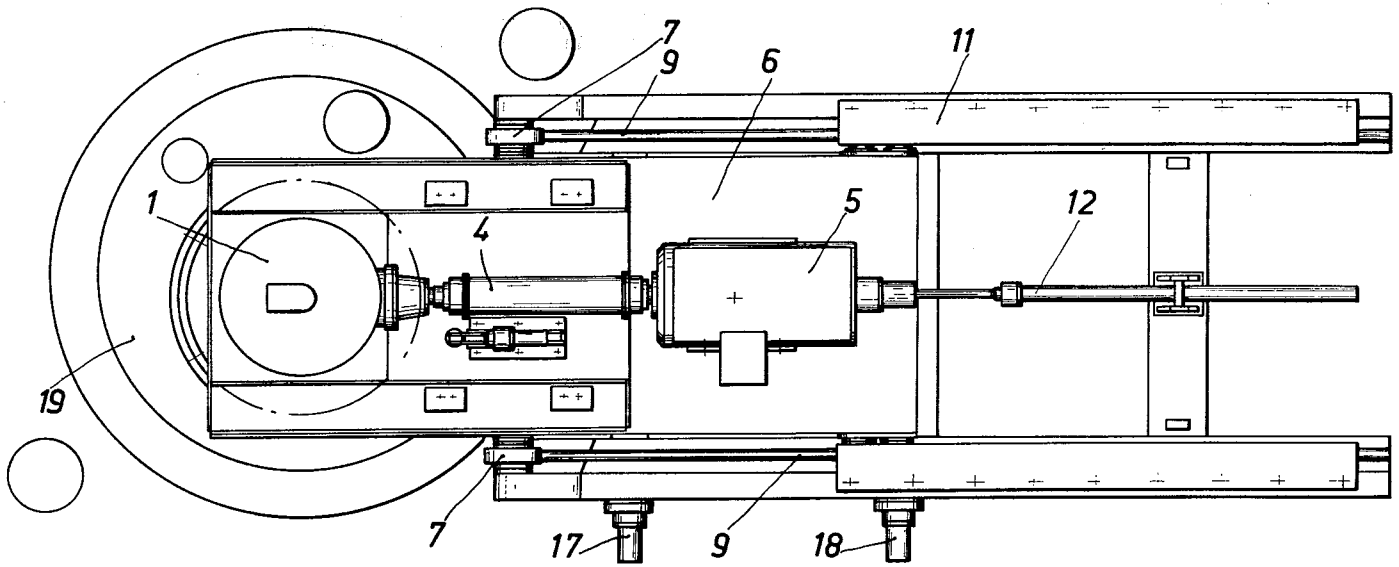
FIG. 2 is a top plan view of the apparatus of FIG. 1.
Figure 3:
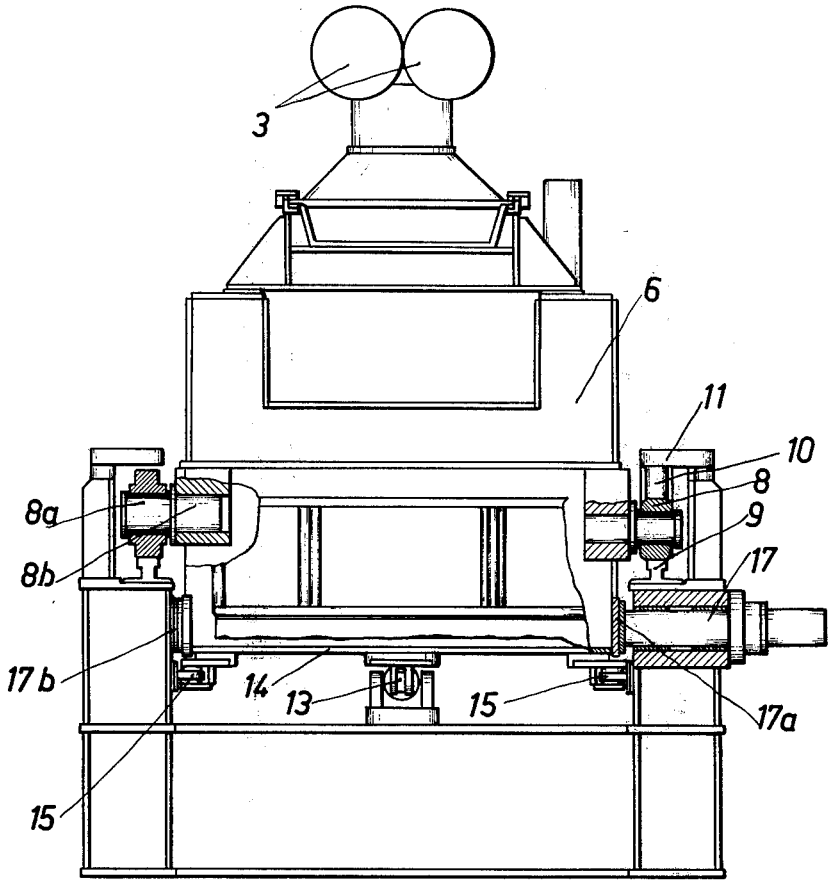
FIG. 3 is a front elevational view, partially cut away, of the apparatus of FIG. 1 as viewed from the left.

In FIGS. 1 to 3, 1 represents an Edenborn reel for coiling rolled wire fed thereto by guide tube 2. 3 is a driving unit for moving the wire into reel 1 and consisting of two rollers, its driving motor being indicated by 4. To operate the reel with the usual revolving guide finger, a driving motor 5 is provided, as will be understood by practitioners in the art. Reel 1 with its pertinent driving units is mounted on frame 6, which is supported on pairs of front and rear wheels 7, 8, respectively. Wheels 7, 8 are supported on guide rails 9.

In operating position, reel 1 is located, as shown in FIGS. 1 and 2, above a treatment container 19, in which the bundle or coil is formed, and which is filled with a liquid treatment medium. As can be seen in the drawings, the reel with its pertinent driving units is supported on frame 6 cantilevered over container 19. Thus, guide rails 9 stop at a distance spaced from container 19. In order to prevent tilting of frame 6 supporting reel 1 if, for example, maintenance or repair work has to be done to the reel and men have to walk on the overhanging part, frame 6 is equipped with additional wheels 10 at the rear end which act as stabilizers by resting against the bottom surface of another guide rail 11.

Frame 6 with reel 1 is moved between the operating position shown in FIGS. 1 and 2, where the reel coils the wire into bundles in container 19, and a retracted rest position, where the top of container 19 is cleared, by reversible piston and cylinder drive 12, its extendible piston rod being pivotally attached at 13 to bottom plate 14 on frame 6. Guide wheels 15, 16 on frame 6 and rotatable on vertical axes engage corresponding vertical surfaces below rail 9 to eliminate any lateral deviations of frame 6 from the direction of motion.

Because of deflecting forces developed during operation of reel 1, clamp cylinders 17, 18 are arranged to secure frame 6 and reel 1 in operating position. In the illustration shown, clamp cylinders 17 and 18 are only arranged on one side of frame 6, or the right side as shown in FIG. 3. The front of the extendible piston rod has a headpiece such as 17*a*, for example, which has a surface of very high frictional resistance. On the side of frame 6 opposite clamp cylinders 17, 18 are plates 17*b* attached to base support 50. Plates 17*b* serve as an opposing abutment for frame 6, when operating cylinders 17, 18 engage frame 6.

As shown in FIG. 1, vertical pipes or tubes 20 are positioned in spaced apart fashion around the inner surface of container 19 for maintaining or holding the windings of the coils or bundles in wound position. Furthermore, ring 36 is arranged around the top opening of container 19, and annular cage 37 is arranged above ring 36. The purpose of ring 36 is to facilitate easy insertion of the coils into the container 19. Cage 37 serves to deflect the wire in the event of service failures. The assembly consisting of parts 36, 37 is movably attached to frame 6, and can be lifted slightly away from container 19 when frame 6 is to be retracted from the operating position of reel 1. Piston and cylinder unit 40 serves to raise and lower the assembly through the rod 38 via toggle lever 39.

Figure 4:
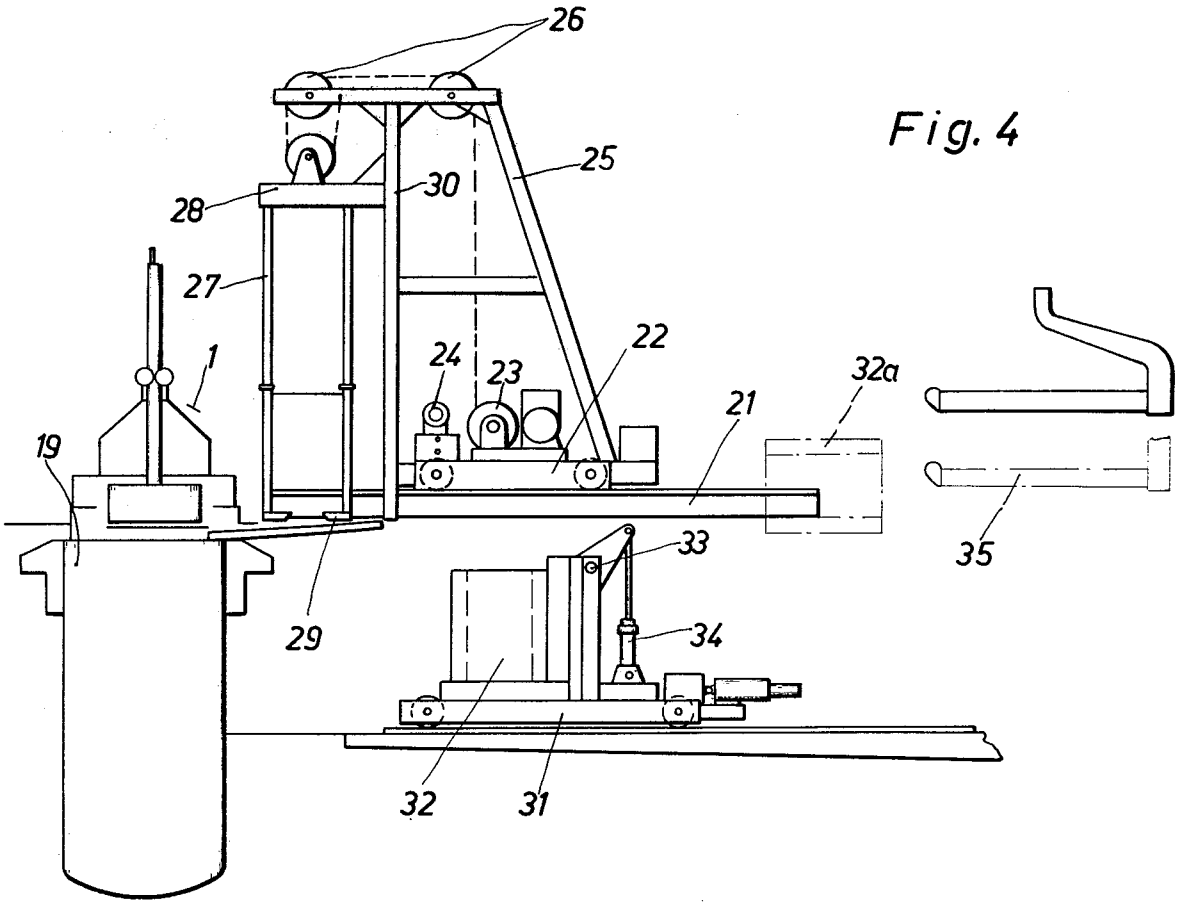
FIG. 4 is a side elevational view illustrating one embodiment of the hoisting apparatus of the invention.

As may be seen in FIG. 4, in the illustration shown, another frame 22 is positioned to move on rail guide 21, in addition to frame 6 carrying reel 1, and at a right angle to the direction of motion of frame 6. Winch 23 is mounted on frame 22, as well as scaffold 25. Scaffold 25 suports pulleys 26 for the cable of winch 23. Scaffold 25 overhangs or is cantilevered from frame 22 on the side facing container 19, so that the load carrying device 27 hanging on the winch cable can be lowered into container 19, when frame 22 has been positioned adjacent to container 19 by means of a drive 24 for moving frame 22 on rail guide 21. The load carrying device 27 consists of supports 27 suspended from headpiece 28. The space encompassed by the supports is greater than the diameter of the bundle deposited in container 19. When load carrying device 27 is lowered into container 19, after a bundle is formed therein and reel 1 has been retracted from container 19, rods or supports 27 move into the space between the formed bundle and the inner surface of container 19. Supports 27 are equipped at the bottom with pivotal fingers 29 movable inward after reaching the bottom of container 19 to reach under the finished bundle or coil. In order to simplify this process, as will be understood, the lower surface of container 19 is provided with spacers or the like, as a base for the formed bundle, so that fingers 29 can pivot under the bundle. The bundle lifted out of container 19 by means of the hoisting unit, as shown in FIG. 4, is transferred from load carrying device 27 to positioner device 31 which includes container 32 hinged at 33. Drive 34, shown as a piston cylinder drive, induces the tilting motion of container 32. After tilting the bundle into position 32*a* in container 32, it may be picked up by a hoist hook 35, for example, for further transportation.

During operation of the apparatus of the invention, the reel and hoisting unit are brought alternately into position above container 19 in a sequential operation. The control of the movements is such that, after each bundle has been finished, the reel is retracted and the hoisting unit is positioned above the container. As soon as the finished bundle is lifted out of the container and the hoisting unit withdrawn from the container top, the reel again moves into position above container 19 to produce the next coil or bundle.

Preferably, in order to assure a non-stop rolling operation in efficient plants, each rolling line will be suitably equipped with two of the installations of the invention. As soon as the wire length required for one bundle has passed one reel, the material supply is switched to the second reel situated above a second container 19. While the bundle is being formed there, the previously described operations take place at the first container 19, i.e. withdrawal of the reel, approach of the hoisting unit, extraction of the bundle, withdrawal of the hoisting unit and, again, approach of the reel. The advantage of the modest space requirement of the treatment facility gains of the invention is multiplied, as will be appreciated, as usually several of these installations are required. There are no problems in arranging the two installations moving toward and away from container 19 so as to suit existing installation requirements. Controls for the various sequential movements have been omitted for clarity. Practitioners in the art will appreciate that the sequence of the various operations is induced by conventional control equipment.

While the forms of apparatus herein described constitute preferred embodiments of the invention, it is to be understood that the invention is not limited to these precise forms of apparatus, and that changes may be made therein without departing from the scope of the invention, which is defined in the appended claims.

I claim:

1. Apparatus for the liquid treatment of hot rolled wire issuing from rolling apparatus, and having a wire coiling reel in vertical axial orientation, power means for driving said reel and a liquid treating container disposed beneath said reel in vertical axial orientation; characterized by a. said container being closed at the bottom with an open top for receiving wire coiled by said reel;

b. a liquid treating medium in said container, said container receiving and treating said wire simultaneously as it is coiled by said reel;

c. first means for supporting said reel over said container;

d. first means including reversible power means for moving said support means toward and away from said container for moving said reel in a first position over said container and then away from said container to a second position;

e. a first pair of rails for supporting said first support means for movement of said reel from said first position to said second position and vice versa; and f. at least one reversible stationary power clamp disposed in said first position of said reel for laterally engaging said first support means in said first position.

2. Apparatus for the liquid treatment of hot rolled wire issuing from rolling apparatus, and having a wire coiling reel in vertical axial orientation, power means for driving said reel and a liquid treating container disposed beneath said reel in vertical axial orientation; characterized by a. said container being closed at the bottom with an open top for receiving wire coiled by said reel;

b. a liquid treating medium in said container, said container receiving and treating said wire simultaneously as it is coiled by said reel;

c. first means for supporting said reel over said container;

d. first means including reversible power means for moving said support means toward and away from said container for moving said reel in a first position over said container and then away from said container to a second position;

e. a first pair of rails for supporting said first support means for movement of said reel from said first position to said second position and vice versa;

f. said reel being cantilevered from said first support means; and g. said first pair of rails ending at a point spaced from said container.

3. The apparatus of claim 2, further characterized by a. a hoisting unit for lifting a coiled bundle of wire from said container;

b. second means for supporting said hoisting unit over said container; and c. second moving means independent of said first moving means for moving said second support means toward and away from said container for moving said hoisting unit to a first position over said container and then away from said container to a second position.

4. The apparatus of claim 2, further characterized by a. said first support means having wheels for rolling support on the upper surface of said first pair of rails; and b. counterwheels on said first support means engaging an opposed bottom surface on said first pair of rails.

5. The apparatus of claim 3, further characterized by a. said hoisting unit including a load carrying device insertable into said container between said container walls and a coiled bundle therein; and b. pivotal support fingers disposed on the lower end of said load carrying device for movement under said coiled bundle in said container.

6. The apparatus of claim 3, further characterized by a. said hoisting unit including a winch and a scaffold on said second support means;

b. said second moving means including a reversible power unit; and c. a second pair of rails for supporting said second support means for moving said hoisting unit from said first position to said second position and vice versa.

7. The apparatus of claim 6, further characterized by a. said scaffold being cantilevered from said second support means; and b. said second pair of rails ending at a point spaced from said container.

* * * * *